United States Patent [19]

Wommer

[11] Patent Number: 4,722,489

[45] Date of Patent: Feb. 2, 1988

[54] DEVICE FOR FEEDING MATERIAL TAPES

[75] Inventor: Thomas Wommer, Leipzig, German Democratic Rep.

[73] Assignee: Veb Kombinat Polygraph "Werner Lamberz" Leipzig, Leipzig, German Democratic Rep.

[21] Appl. No.: 865,552

[22] Filed: May 20, 1986

[30] Foreign Application Priority Data

Dec. 7, 1985 [DD] German Democratic Rep. ..... 2785248

[51] Int. Cl.[4] ..... B65H 19/18; B65H 19/20

[52] U.S. Cl. ..... 242/58.4; 156/157; 156/502; 156/504; 242/58.1; 242/58.5

[58] Field of Search ..... 242/58.1–58.6; 156/502, 504–507, 157, 159

[56] References Cited

U.S. PATENT DOCUMENTS

| | | | |
|---|---|---|---|
| 3,398,911 | 8/1968 | Poupin | 242/58.4 |
| 3,841,944 | 10/1974 | Harris, Jr. | 156/504 |
| 3,880,698 | 4/1975 | Kawazura et al. | 156/504 |
| 3,971,524 | 7/1976 | Nudinger et al. | 242/58.4 |
| 4,169,752 | 10/1979 | Tokuno | 156/157 |
| 4,286,756 | 9/1981 | Vits | 242/58.1 |
| 4,386,988 | 6/1983 | Kontz | 242/58.4 X |
| 4,466,577 | 8/1984 | Focke et al. | 242/58.4 X |
| 4,481,053 | 11/1984 | Tokuno et al. | 242/58.1 X |
| 4,564,413 | 1/1986 | Murakami | 156/504 |
| 4,629,531 | 12/1986 | Kataoka | 242/58.2 X |

FOREIGN PATENT DOCUMENTS

| | | |
|---|---|---|
| 2919794 | 11/1979 | Fed. Rep. of Germany . |
| 3411398 | 10/1984 | Fed. Rep. of Germany . |

*Primary Examiner*—John Petrakes
*Attorney, Agent, or Firm*—Michael J. Striker

[57] ABSTRACT

A device for feeding a material tape from a supplement roll at a preparation station to another material tape wound off an un-winding roll positioned at a connection station includes a first and a second feeding arrangement, each including a fixed rotatable deflecting roller, a swingable rotatable deflecting roller spaced from the fixed roller and swingable about the axis of the latter, and a drive carrying a fixing bar to which a starting end of the material tape to be fed is fixed. The drive pivots the fixing bar with the tape end from the preparation station to the connection station at which the starting end of the material tape of the supplement roll is connected to the material tape of the un-winding roll.

3 Claims, 4 Drawing Figures

DEVICE FOR FEEDING MATERIAL TAPES

BACKGROUND OF THE INVENTION

The present invention relates to a device for feeding material webs or tapes for a roll exchanger, particularly in quickly-running paper and film processing machines in which the starting end of the material tape of the supplement roll is fed to the material tape of the running winding roll.

The starting end of the material tape is fixed at the easily accessible preparation station, cut and provided with a glueing film or glueing strips and then is connected to the material type of the feeding winding roll at the connection station to which access is rather difficult. The material tape is held during the connection step at the connection station and the processing machine is supplied with the tape from the magazine.

One of the feeding devices of the type under discussion is disclosed in DE-OS No. 29 19794. In this device the starting end of the tape of the supplement roll manually cut and provided with a glueing film or strip, is prepared and then guided to the connection station where this starting end is glued to the material tape of the winding roll to be replaced and the remaining portion of the previous winding roll is separated whereby after the connection an approximately uniform tape clamping is ensured. The tape starting end is prepared at the fixing bar, then removed and by hand inserted into a slot which is formed between the fixing bar and the deflecting roller. By means of blow air the starting end of the tape is fed to the clamping roll unless the tape is again straightened The required threading of the tape into the aforementioned slot is the main disadvantage of the conventional device because it requiries an additional operation step which must be carried out by hand.

A device disclosed in DE-OS No. 34 11 398 is limited to a manual preparation because the starting end of the material tape of the supplement or substitute roll should lie on the fixing strip or bar, cut off and provided by the glueing strip. The starting end of a new material tape is moved automatically to the connection station. With this device, overlapping and butt connections can be produced. This device has the disadvantage which resides in that at high machine speeds it can occur that during the pivoting of the fixing bar from the preparation station to the connection station, the material tape of the winding roll to be replaced is affected, and the device for feeding and additional devices for straightening the tape are required resulting in increased costs of the whole machine. Portions of the connection station together with the deflecting rollers for the material tape have been moved over to enable the pivoting motion of the fixing bar from the preparation station to the connection station.

SUMMARY OF THE INVENTION

It is an object of the present invention to provide an improved device for feeding material tapes in a roll exchanger.

It is a further object of the invention to reduce costs and minimize disadvantages of conventional devices of the foregoing type.

It is yet another object of the invention to provide a device which is easy to operate and in which the functions of the roll exchanger would be improved.

In the device for feeding material tapes according to the invention, the end of the tape of the supplement roll, provided at the easily-accessible preparation station with glue means for being eventually glued to the tape running off the winding roll, is fed automatically and quickly with little technical expenses so that during this feeding a new material tape has almost the same pulling tension and/or length as immediately before the beginning of the feeding from the preparation station to the connection station. In the device of this invention, the new material type does not affect directly or indirectly the material tape of the winding roll due to the feeding process to the connection station.

The device can operate without requiring movement of the structural components of the processing machine out of the way of the tape feeding elements.

. Technical expenses are substantially reduced in the feeding device of the invention, and the supplement roll can be arranged above and below the winding roll as well.

The objects of the invention are attained by a device for feeding material tapes for a roll exchanger in quick-operating paper and film-processing machines, comprising a supplement roll with a material tape thereon, a starting end of which is fixed, cut and provided with glueing means at a preparation station under retention of tension realized at said preparation station immediately before beginning of an automatic feeding and/or length of the material tape from said cut starting end, said end being movable from said preparation station to a connection station and thereby said material tape being fed to a previous winding roll at said connection station, a first tape-feeding means and a second tape-feeding means each including a stationarily supported deflecting roller rotatable about an axis thereof, a swingable deflecting roller rotatable about an axis thereof and swingable a crank hingedly connected at one end to one axis and at the other end to the other axis, a fixing bar positioned at a stable distance from the other axis, a connecting rod, and a rocking arm, said connecting rod being pivotally connected to said rocking arm and rigidly connected to the other axis, said crank and said connecting rod being members of a drive which forms a movement path for said fixing bar, said movement path including two superimposed circular movements, said first feeding means being assigned to said supplement roll and said second feeding means being assigned to said winding roll so that the material tape of the supplement roll is firstly fed over the deflecting roller and then looped over the swingable deflecting roller over a S-shaped path and said fixing bar together with said starting end provided with glueing means of the first feeding means is pivoted from said preparation station to said connection station to be positioned in a mirror-inverted relationship with the fixing bar of said second feeding means.

The drive of each feeding means may be a four-link drive including traverse cranks and rocking arms, and wherein an operation angle covered by said cranks is approximately equal to an angle ($\phi$) provided that the diameters of said deflecting rollers are the same.

Each fixing bar may be formed as a fixing roller.

The diameter of each stationarily supported deflecting roller may be equal to the diameter of the swingable deflecting roller.

The advantage of the material tape feeding device according to the invention resides in that the feeding of the once-fixed and cut end of the tape of the supplement or substitute roll can be carried out automatically and quickly by simple means even at high machine speeds so that the material tape of the winding roll is not affected directly or indirectly. Good assumptions are provided for jerk-free accelerations of the material type from the supplement roll and thus good assumptions are given for preventing breaks in the material tape because tension and/or length of the tape being fed between its end and the supplement roll during the feeding process remains unchanged. Manual and technical expenses therefore do not depend on whether the butt connection or overlapping connection is produced and on whether the supplement roll is arranged above or below the winding roll and in which direction the winding roll rotates.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
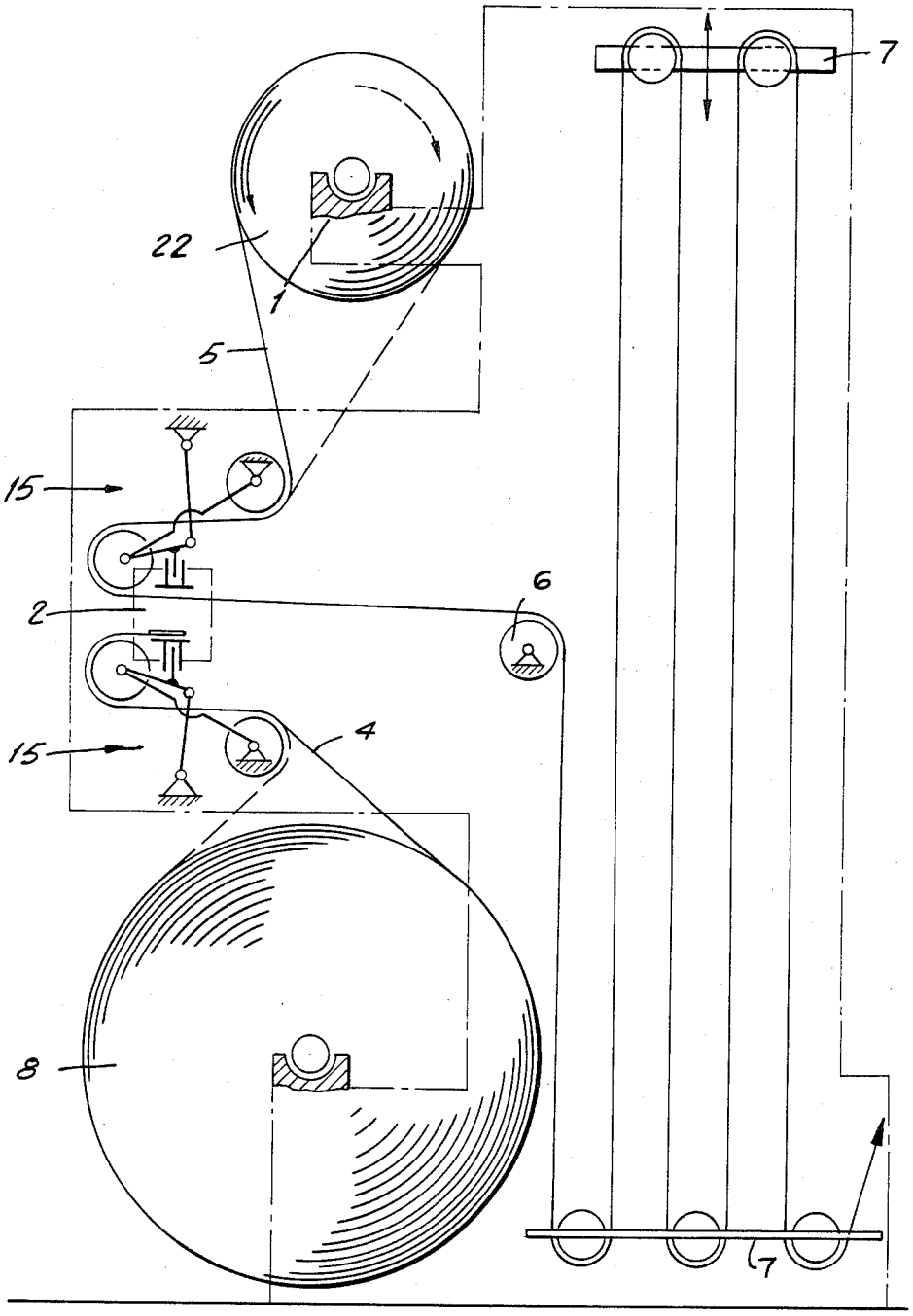
FIG. 1 is a schematic view of the device for feeding material webs according to the invention.

Referring now to the drawings in detail, and firsty to FIG. 1 thereof, it will be seen that two analogously designed devices for feeding material webs or tapes are arranged on a frame 1 so that in their connection position they are arranged in a mirror-inverted position relative to each other, and both devices in the connection position form a common connection station 2 in which, upon a cooperation of fixing bars 3 (FIGS. 2–4) via non-illustrated but conventional devices, the connection of the end of a material web 4 to be transported, of a supplement or substitute roll 8 with a previously processed material web 5 of a unwinding roll 22 is realized, and a separation of the remaining material web 5 of the unwinding roll 22 is realized via commonly known and non-illustrated devices.

In the direction of running of the material web, are arranged the aforementioned connection station 2, a guide roller 6 and a magazine 7 connected to frame 1.

For the sake of simplicity, firstly a device for feeding material tapes, assigned to the supplement roll 8 will be described below with reference to FIGS. 1 to 3.

Figure 2:
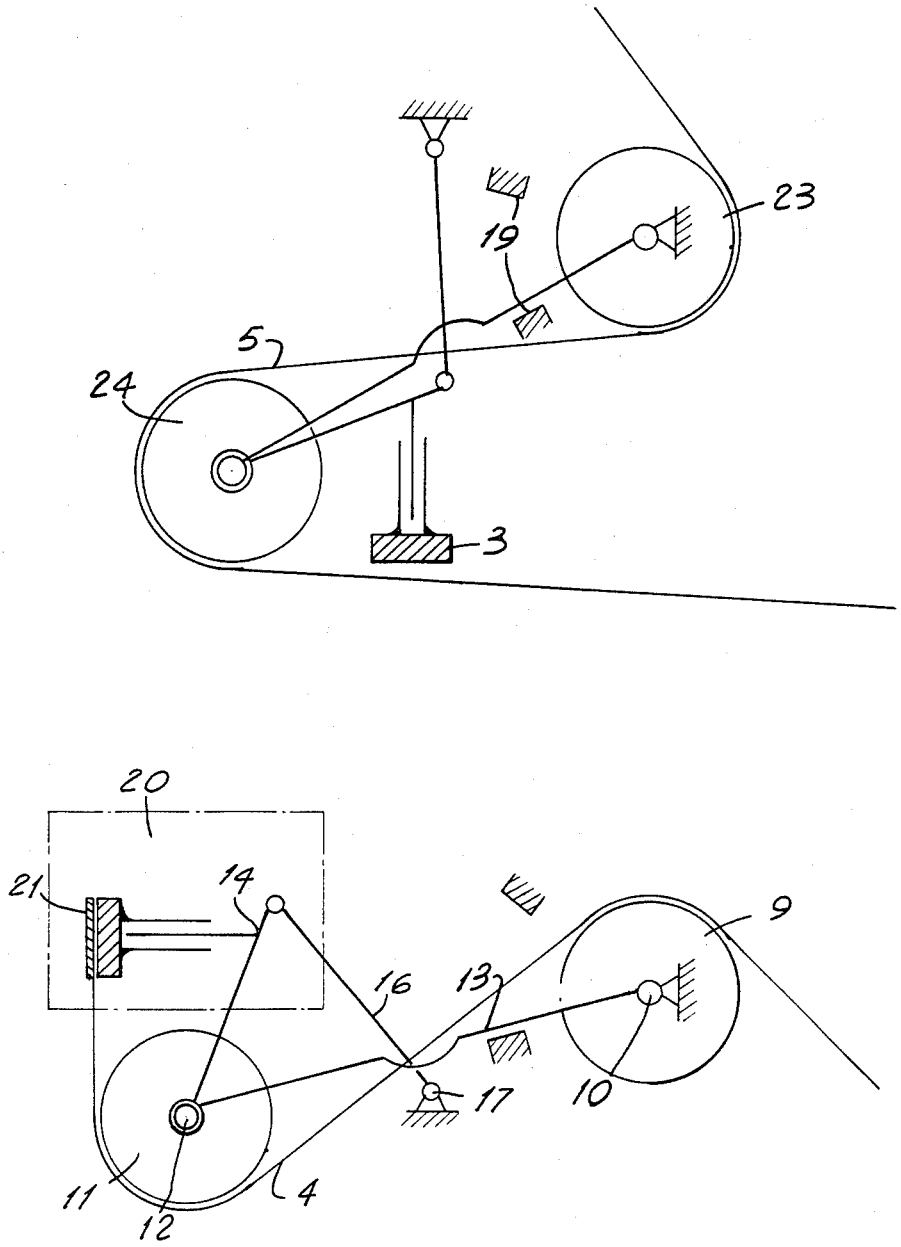
FIG. 2 is a schematic view of a portion of of FIG. 1, on enlarged scale, illustrating one of the devices for feeding material tapes in a connection position and a second device in a preparation position.
Figure 3:
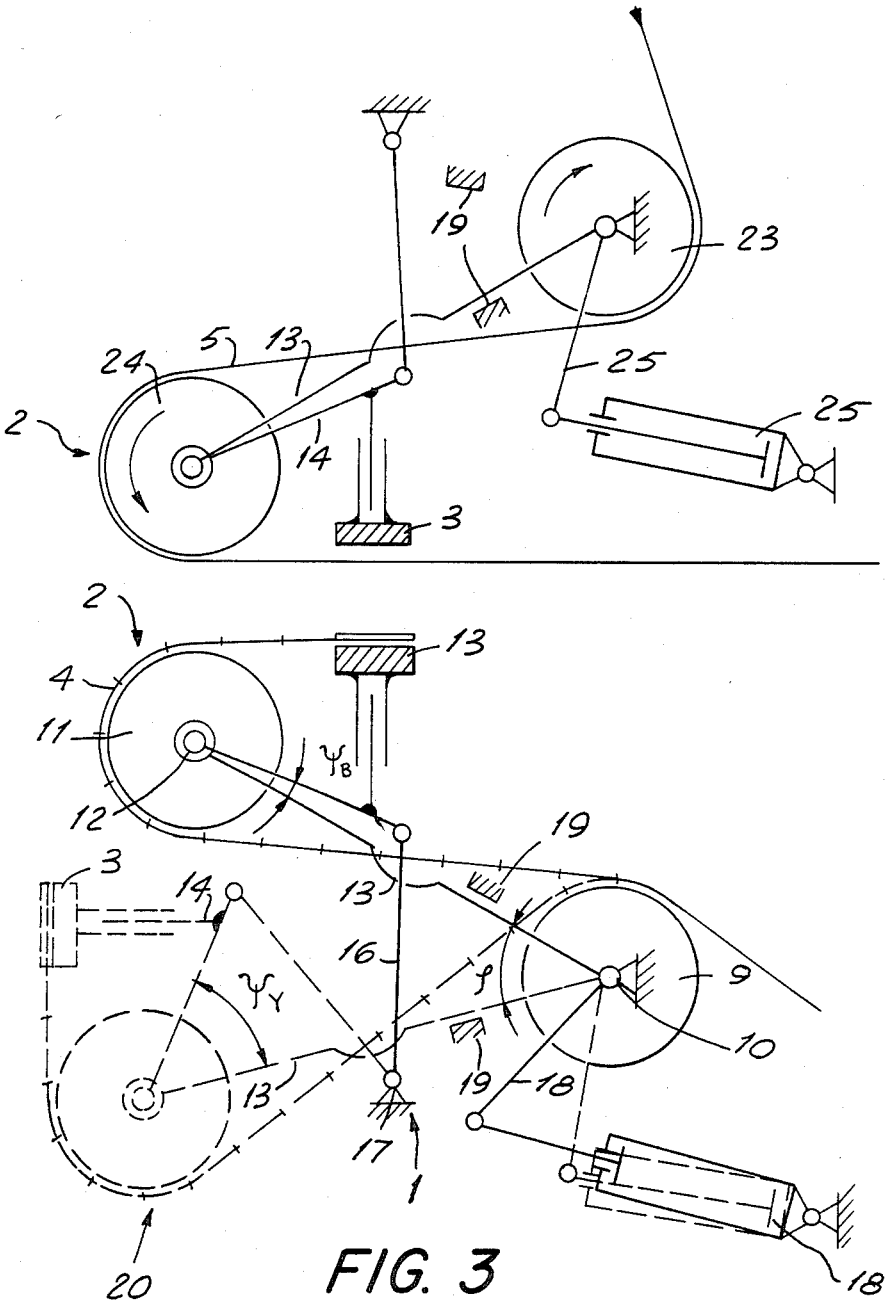
FIG. 3 is a schematic view of an enlarged portion of FIG. 1, similar to that of FIG. 2, showing two mirror-inverted devices for feeding material webs, in a connection position.

According to FIGS. 2 and 3, at two sides of the frame 1, a stationarily supported deflecting roller 9 and a swingable deflecting roller 11 are positioned, deflecting roller 9 being rotatable about its axis 10 while deflecting roller 11 is rotatable about its axis 12. Rollers 9 and 10 are arranged so that axis 12 of the swingable deflecting roll 11 is swingable along a circular path about axis 10 of the stationarily supported deflecting roller 9. Rollers 9 and 11 are hingedly connected to each other by common cranks 13 positioned at both sides of the rollers; and fixing bar or strip 3 is positioned at a stable distance from a connecting rod 14 arranged at each side of the roller. The fixing bar or strip 3 is rigidly connected at two sides with a drive 15 which is formed in the exemplified embodiment as a four-link drive including the frame 1, crank 13, connecting rod 14 and a rocking arm 16.

Figure 4:
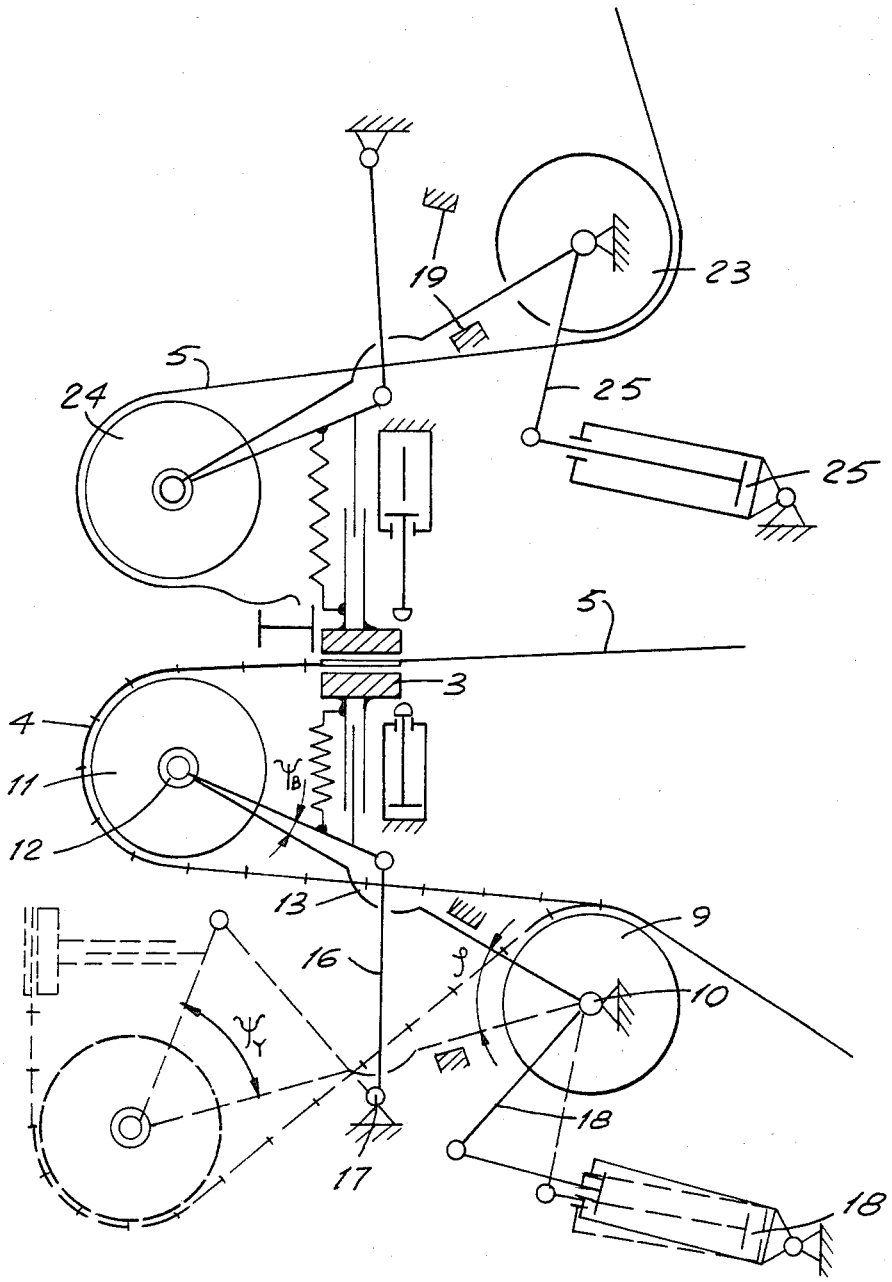
FIG. 4 is a view similar to those of FIGS. 2 and 3, wherein a previously running tape is separated, the end of a new tape end is glued to the previous tape and the tape is at standstill.

In order to keep the material tape 4 constantly taut with the above described drives 15 the following conditions must be fulfilled:

The ratio of the operating angle $\phi$ which is covered during operation by the crank 13 to the angle $\psi$ which is defined by the angle difference formed between the angle $\psi_y$ included between the crank 13 and connecting rod 14 in the end position in the preparation station and the angle $_B$ included between crank 13 and connecting rod 14 in the end position in the connecting station namely $\psi=\psi_y-\psi_B$ must correspond to the ration between the diameter of the swingable deflecting roller 11 and the diameter of the stationarily supported deflecting roller 9 (as shown in FIGS. 3 and 4), whereby about 15 similar tape portions in both end positions would be detected so that upon swinging out fromt he preparation position, shown by dash-dotted line in FIG. 3, to the connection position shown by solid line, no change in a tape pulling tension would result. The drive 15 can be formed in addition to other possibilities as a gear drive with a rigid gear and a driven arm.

Rocking arms 16 of each drive of rollers 9, 11 are hingedly supported on the frame 1 by means of hinges 17 and connecting rods 14. With a given length of each rocking arm 16 and selected distance between the stationary axis 10 and the hinge 17, the lengths of each connecting rod 14 and the rocking arm 16 are adjusted so that in a relevant working range the transmission of the four-link drive 1, 13, 14, 16 corresponds to the ratio between the diameter of the deflecting roller 9 and the diameter of the swingable deflecting roller 11, whereby the fixing bar or strip 3 connected to the connecting rods 14 as shown in FIG. 3 is movable over the path, which results from the superposing of the circular path about axis 12 of the deflecting roller 11 and the circular path about the axis 10 of the deflecting roller 9.

One of the cranks 13 and thereby the axis 10 formed as a shaft are driven by a pheumatic cylinder 18 via a lever 18' as shown in FIG. 3.

The working range of the devices for feeding the material tapes is limited by stops 19 ridigly secured to the frame 1 so that cranks 13 can strike against stops 19 whereby the aforementioned end positions will be defined. This range is limited so that the surface of the fixing bar 3 which holds the starting end of the material tape 4 is swingable by about 90° between the easily-accessible preparation station 20 as shown by solid line in FIG. 2 and dash-dotted line in FIG. 3 and difficulty-accessible connection station 2 shown in FIG. 1 for both the unwinding roller tape and the supplement roll tape and also shown in FIG. 3 by solid line as described hereinabove. The preparation station 20 is usually positioned at the place which is easily accessible to operators. At this place the fixing bar 3 is positioned so that the starting end of the material tape 4 of the supplement roll 8 can be in the known fashion fixed, cut and provided with a glueing film or glueing strip 21 which is normally done manually or by means of non-shown but known auxuliary devices.

The device for feeding material tapes is arranged on the supplement roll 8 supported on the frame 1 so that firstly, the stationarily supported deflecting roller 9 and then the swingable deflecting roll 11 are wrapped around by the material tape 4 of the supplement roll 8 in the S-shaped fashion as seen in FIG. 1, independently on whether the supplement roll 8 should rotate clockwise or counterclockwise. As seen from FIG. 1, the starting end of the material tape 4 of the supplement roll 8 is pulled away from the roll 8 and is then guided over the S-shaped path over the deflecting roller 9 and the swingable deflecting roller 11 towards the fixing bar 3 which can be preferably made as a suction strip or suction strip or suction roller. The starting end of the material tape 4 is fixed at the fixing bar 3, cut and provided with the glueing film or strip 21 as seen in the lower device of FIG. 2. Due to the position of the cut edge selected by an operator as well as the type of the glueing strip 21 and its application, it is determined in the preparation station 20 whether a butt connection or an overlapping connection of the tapes is to be produced. Then an automatic feeding of the starting end of the material tape of the supplement roll 8 can be released by the personnel in the known fashion.

The fixing bar or strip 3 together with the lower second device for feeding material tapes and the starting end of the tape fixed thereto, is moved by cranks 13 of the four-link drive 1, 13, 14, 16 driven by the pneumatic cylinder 18 from the perparation station 20 to the connection station 2. Independently from the position of the lower device for feeding material, the upper device for feeding material tapes which is arranged mirror-inverted relative to the lower device can remain in its connection position, and the tape 5 is pulled away from the rotating unwinding roll 22 and guided over the stationarily supported deflecting roller 23 and swingable deflecting roller 24 which are rotated in a counter direction due to the S-shaped loop. The material tape 5 is fed, after passing the connection station 2, over the guide roller 6 and the magazine 7 of the preparation station as shown in FIG. 1. While the material tape 5 is pulled from the un-winding roll 22 the upper device for feeding material tapes remains non-operative according to FIGS. 1–3. The upper device can be pivoted by means of the pneumatic cylinder 25 via the lever 25' to its non-illustrated preparation position as soon as the starting end of material tape 4 of the supplement roll 8 is connected in the connection station with the material tape 5 of the rotatable un-winding roll 22 and the remaining portion of the material tape 5 is separated from the new material tape 4 to be fed to the preparation machine. Due to the connection of the material tape 4 of the supplement roll 8 with the material tape 5 of the un-winding roll 22 of the separation of the remaining portion of the previous tape etc. takes place from the previous supplement roll to the feeding roll.

The starting end of the material tape of the yet further upwardly arranged supplement roll is analogously prepared and supplied as shown for the downwardly positioned supplement roll 8 and the respective device for feeding material tapes in FIGS. 1–3.

It will be understood that each of the elements described above, or two or more together, may also find a useful application in other types of devices for feeding material tapes differing from the types described above.

While the invention has been illustrated and described as embodied in a device for feeding material tapes, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims, I claim:

1. In a device for feeding material tapes for a roll exchanger in quick-operating paper and film-processing machines, comprising a supplement roll (8) with a material tape thereon, a starting end of which is fixed, cut and provided with glueing means at a preparation station under retention of tension realized at said preparation station immediately before beginning of an automatic feeding, and/or length of the material tape from said starting end, said end being movable from said preparation station to a connection station and thereby said material tape being fed to a an un-winding roll at said connection station, the improvement comprising a first tape-feeding means and a second tape-feeding means each including a stationarily-supported deflecting roller (9) rotatable about an axis (10) thereof, a swingable deflecting roller (11) rotatable about an axis (12) thereof and swingable about the axis (10) of said stationarily-supported roller, a crank 13 hingedly connected at one end to the axis (10) of said stationarily-supported roller and at the other end to the axis (12) of said swingable roller, a fixing bar (3) positioned at a stable distance from the axis (12) of said swingable roller, a connecting rod (14) and a rocking arm (16), said connecting rod being pivotally connected to said rocking arm and rigidly connected to the axis (12) of said swingable roller, said crank and said connecting rod forming a drive (15) of the respective feeding means, said drive providing a movement path for said fixing bar (3), said movement path including two superimposed circular movements, said first feeding means being assigned to said supplement roll and said second feeding being assigned to said un-winding roll so that the material tape of the supplement roll is firstly fed over the stationarily-supported deflecting roller (9) and then looped over the swingable deflecting roller (11) in a S-shaped path, and said fixing bar together with said starting end provided with glueing means (21) of the first feeding means is pivoted from said preparation station to said connection station to be positioned ina mirror-inverted relationship with the fixing bar of said second feeding means.

2. The device as defined in claim 1, wherein the drive (15) of each feeding means is a four-link drive including two traverse cranks and two rocking arms, and wherein an operation angle ($\phi$) covered by each of said cranks is approximately equal to an angle ($\psi$) defined by a difference between an angle $\psi_Y$ included between a crank and a connecting rod in end positions thereof at said prepation station and an angle $\psi_B$ included between the crank and the connecting rod in end positions thereof at said connection station, provided that the diameters of said deflecting rollers (9, 11) are the same.

3. The device as defined in claim 1, wherein the diameter of each stationarily-supported deflecting roller is equal to the diameter of the swingable deflecting roller.

* * * * *